US006435921B2

(12) United States Patent
Kojima et al.

(10) Patent No.: US 6,435,921 B2
(45) Date of Patent: Aug. 20, 2002

(54) CONNECTOR AND A SET OF TERMINAL FITTINGS

(75) Inventors: Eiji Kojima; Masahiko Aoyama, both of Yokkaichi; Masanori Wakui, Aichi-ken; Keiichi Itou, Aichi-ken; Kazuyuki Shiraki, Aichi-ken, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/803,499

(22) Filed: Mar. 9, 2001

(30) Foreign Application Priority Data

Mar. 15, 2000 (JP) ..... 2000-071892

(51) Int. Cl.[7] ..... H01R 13/514
(52) U.S. Cl. ..... 439/752; 439/399; 439/877
(58) Field of Search ..... 439/752, 399, 439/397, 406, 595, 877, 878, 879, 880, 881, 882

(56) References Cited

U.S. PATENT DOCUMENTS 5,295,871 A * 3/1994 Lapraik et al. ..... 439/746
5,609,503 A * 3/1997 Tsuji et al. ..... 439/752
5,653,616 A * 8/1997 Hotea ..... 439/851
5,683,274 A * 11/1997 Straeb et al. ..... 439/839
5,695,358 A * 12/1997 Myer et al. ..... 439/468
5,971,816 A * 10/1999 Chaillot ..... 439/852
5,997,363 A * 12/1999 Joly ..... 439/748
6,000,967 A 12/1999 Norizuki et al. ..... 439/596
6,033,262 A * 3/2000 Heimuller et al. ..... 439/595
6,068,505 A * 5/2000 Sai ..... 439/422
6,126,495 A * 10/2000 Lolic et al. ..... 439/839

FOREIGN PATENT DOCUMENTS

EP 0 644 619 A2 * 3/1995
JP 11-31547 2/1999

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A connector has a housing (2) with cavities (4) for accommodating both crimping and insulation-displacement terminal fittings (5, 6). Locks (15) extend into the cavities (4) to elastically engage the terminal fittings (5, 6). A retainer mount opening (17) extends through an outer wall of the housing (2) and communicates with the cavities (4), and a retainer (3) is mounted in the opening (17) for doubly locking the terminal fittings (5, 6). Connecting portions (8) of the same shape are provided at the front of the terminal fittings (5, 6). The height of insulation-displacement portions (7) is shorter than that of the connecting portion (8) in the insulation-displacement terminal fitting (5), and terminal locks (18) of the retainer (3) engage with steps (8A) at the rear of the connecting portions (8). The retainer (3) can be pushed to a full locking position after the terminal fittings (5, 6) are mounted with the housing (2) to redundantly lock the terminal fittings (5, 6) in the cavities (4).

3 Claims, 8 Drawing Sheets

CONNECTOR AND A SET OF TERMINAL FITTINGS

BACKGROUND OF THE INVENTION

1. Field of the Invention

The present invention relates to a connector that is capable of accommodating both crimping terminal fittings and insulation-displacement terminal fittings. The invention also is directed to a set of such terminal fittings.

2. Description of the Related Art

The prior art includes crimping terminal fittings that have sections configured for crimped engagement with the exposed conductive core of a wire. The prior art also includes insulation displacement terminal fittings that have sections configured to cut through the outer coating of the wire and to contact the conductive core. Some connectors are formed to accommodate only crimping terminal fittings, while other connectors are formed to accommodate only insulation displacement terminal fittings. However, the existence of several kinds of connectors increases the time to connect the connectors with each other. Hence, it is convenient to reduce the number of kinds of connectors.

Japanese Unexamined Patent Publication No. 11-31547 and FIGS. 11–13 of this application show a connector housing 100 with cavities 101 configured to accommodate both crimping terminal fittings and insulation displacement terminal fittings. The housing 100 has upper and lower retainers 104, each of which is coupled to the housing 100 by a pair of front hinges 102 and a pair of rear hinges 103 provided at the opposite sides of the housing 100. The front hinges 102 are cut when crimping terminal fittings are accommodated in the cavities 101. The retainers 104 then are pushed toward the housing 100, as shown in FIG. 12. On the other hand, the rear hinges 103 are cut when insulation-displacement terminal fittings are accommodated in the cavities 101. The retainers 104 then are rotated forwardly and are assembled to the front end of the housing 100, as shown in FIG. 13.

Retainers of the same shape cannot lock the two kinds of terminal fittings. Thus, the mounting modes of the retainers 104 have to be changed depending on the kind of the terminal fittings accommodated in the cavities 101. The connector of FIGS. 11–13 is designed to adapt to the crimping or insulation-displacement terminal fittings by changing the mounting mode of the retainers 104 according to the kind of the terminal fittings accommodated in the cavities 101. Consequently, an assembling process is complicated and automation is difficult.

Additionally, the mounted positions of the retainers 104 differ depending on the kind of the terminal fittings accommodated in the cavities 101. Therefore, it is necessary to accommodate the same kind of terminal fittings in the cavities 101 at the upper or lower stage.

In view of the above problems, it is an object of the present invention to provide a connector that can accommodate both crimping and insulation-displacement terminal fittings and that can be assembled by an automated apparatus. Moreover, it is an object to provide a set of such terminal fittings.

SUMMARY OF THE INVENTION

The invention is directed to a connector that comprises at least one crimping terminal fitting. The crimping terminal fitting has a connecting portion that can be connected with a mating terminal fitting and at least one barrel behind the connecting portion. The barrel is configured for crimped connection with an exposed section of a core of a wire. The connector also comprises at least one insulation-displacement terminal fitting with a connecting portion and insulation-displacement portions behind the connecting portion. The insulation displacement portions are connectable with a core of a wire by cutting an outer coating of the wire. The connector further comprises a housing with a retainer mount opening and with cavities into which both terminal fittings can be inserted. A retainer is configured to mount in the retainer mount opening to lock the terminal fittings in the cavities. The height of the insulation-displacement portions is shorter than the height of the connecting portion in the insulation-displacement terminal fitting.

The connecting portion of the crimping terminal fitting and the connecting portion of the insulation-displacement terminal fitting preferably are substantially identical in shape.

The retainer mount opening preferably communicates between lateral sides of the cavities and the outside of the housing.

Terminal locks may project from the retainer for engagement with both the crimping terminal fitting and the insulation-displacement terminal fitting.

As noted above, the height of the insulation-displacement portions is less than the height of the connecting portion in the insulation-displacement terminal fitting. Thus, terminal locks that engage both the crimping terminal fitting and the insulation-displacement terminal fitting can be formed to project from the retainer. More particularly, both the crimping terminal fittings and the insulation-displacement terminal fittings can be mounted in the cavities of the housing, and the retainer can lock both types of terminal fittings in the housing.

The retainer is of the side type and can assemble the terminal fittings in the same locking position regardless of the kind of the terminal fittings. Therefore, automation can be implemented easily.

The connecting portion of the crimping terminal fitting and the connecting portion of the insulation-displacement terminal fitting preferably have steps at substantially the same relative position and the same orientation relative to the retainer and/or housing, when the terminal fittings are inserted in the cavities.

The connecting portion of the crimping terminal fitting and the connecting portion of the insulation-displacement terminal fitting may have lock engaging means for engaging mating locks in the housing when the terminal fittings are inserted in the cavities. The mating locks preferably can lock both the crimping terminal fitting and the insulation-displacement terminal fitting.

The invention also is directed to a set of terminal fittings to be inserted into cavities of a connector. The set of terminal fittings comprises at least one crimping terminal fitting with a connecting portion that can be connected with a mating terminal fitting and at least one barrel for crimped connection with an exposed section of a core of a wire. The set of terminal fitting further comprises at least one insulation-displacement terminal fitting with a connecting portion and with insulation-displacement portions for connection with a core of a wire by cutting an outer coating of the wire. The height of the insulation-displacement portions is less than the height of the connecting portion in the insulation-displacement terminal fitting.

The connecting portion of the crimping terminal fitting and the connecting portion of the insulation-displacement terminal fitting preferably are substantially identical in shape.

The connecting portion of the crimping terminal fitting and the connecting portion of the insulation-displacement terminal fitting may have lock engaging means for engaging corresponding mating locking means in the housing when the terminal fittings are inserted in the cavities.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
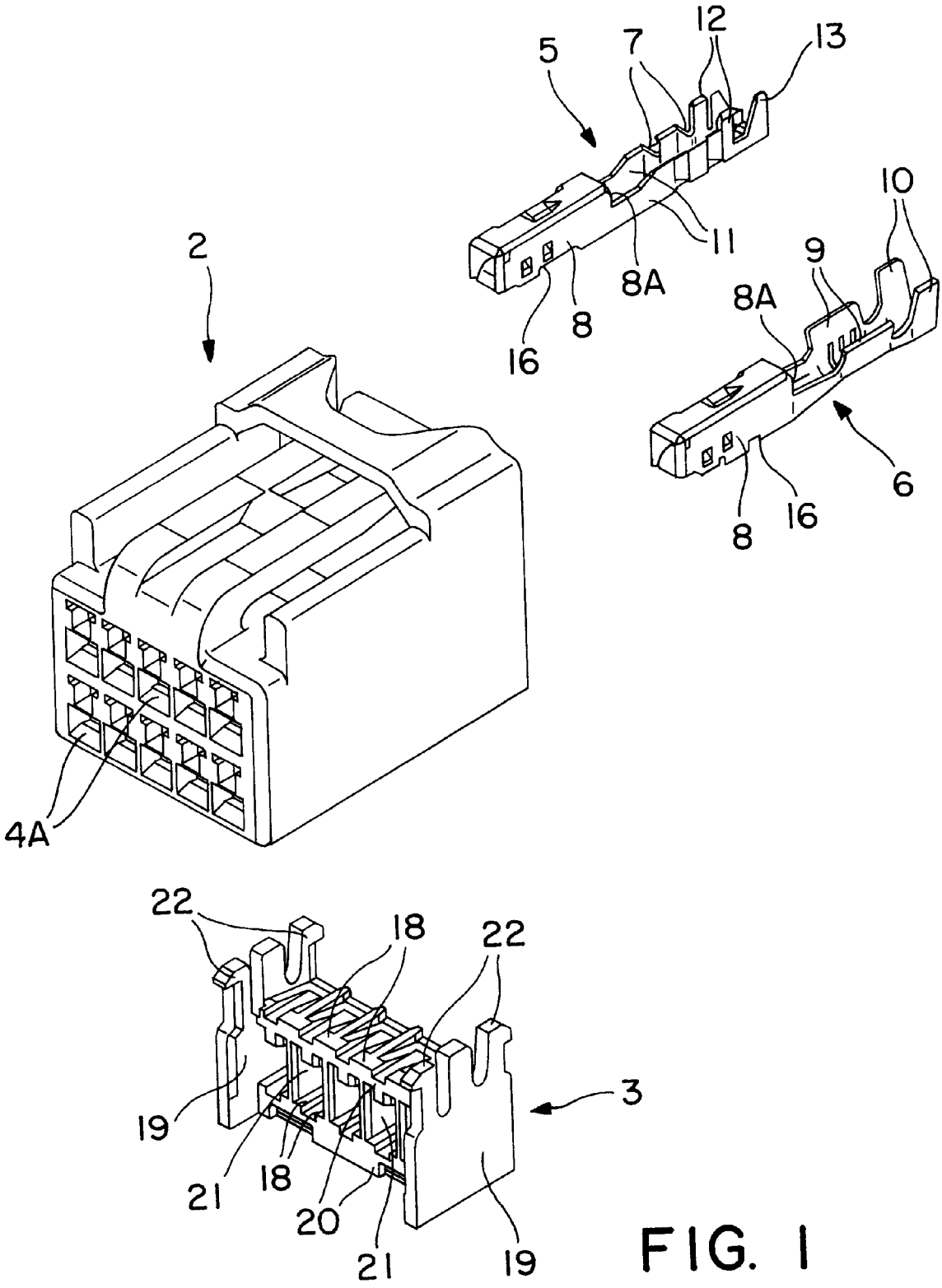
FIG. 1 is an exploded perspective view of a connector according to one embodiment of the invention.

A connector according to the invention is identified by the numeral I in FIG. 1. The connector 1 has a housing 2 and a retainer 3 that can be assembled with the housing 2 from the side or below. The housing 2 has a plurality of cavities 4 that extend through the housing 2 from front to rear. The connector 1 also has two kinds of terminal fittings, namely, insulation displacement terminal fittings 5 and crimping terminal fittings 6. The insulation-displacement terminal fittings 5 have insulation-displacement portions 7 that are configured for connection with the cores WA of the wires W by cutting the outer coatings of the wires W. The crimping terminal fittings 6 can be connected to the cores WA of the wires W after a section of the outer coating of the wire W has been removed. Both kinds of terminal fittings 5, 6 can be accommodated in the cavities 4 of the housing 2.

The crimping terminal fitting 6 is made from a conductive metallic plate material that is stamped out or cut into a specified shape. The front end of the stamped or cut metallic plate material is formed into a rectangular tubular connecting portion 8 into which a tab of a mating male terminal fitting (not shown) can be inserted. Engaging holes 16 are formed in sidewalls of the connecting portion 8 and can be engaged with locks 15 in the housing 2. A step 8A is formed at the rear of the connecting portion 8, and wire barrels 9 are provided behind the step 8A. The wire barrels 9 can be crimped into electrical connection with the core WA of the wire W. Insulation barrels 10 project a longer distance than the wire barrels 9 from a location behind the wire barrels 9. The insulation barrels 10 can be crimped into connection with an outer coating WB of the wire W. The crimped barrels 9, 10 have a lower height than the connecting portion 8.

The insulation-displacement terminal fitting 5 also is made by stamping out or cutting a conductive metallic plate material into a specified shape. The front end of the stamped or cut plate material then is formed into a rectangular tubular connecting portion 8 into which a tab of a mating male terminal fitting can be inserted. The connecting portions 8 of the crimping and insulation-displacement terminal fittings 5, 6 preferably are substantially identical. A step 8A is formed at the rear of the connecting portion 8, and insulation displacement portions 7 are provided behind the step 8A. The insulation-displacement portions 7 are formed by embossing left and right side walls 11 of the insulation-displacement terminal fitting 5 inwardly into wavy shape, and sharp blades 7A are formed at their upper ends. The insulation displacement portions 7 have a lower height than the stepped portion 8A.

A wire W can be pushed transversely between the opposite side walls 11 of the insulation displacement terminal fitting 5. Pushing forces on the wire W cause the blades 7A to cut the outer coating WB of the wire W. Further pushing of the wire W causes the insulation-displacement portions 7 to contact the core WA electrically and to hold the core WA from opposite sides. A pair of projections 12 project from the opposite side walls 11 behind the insulation-displacement portions 7. A projecting distance of the projections 12 equals the height of the connecting portion 8. Upper ends of the projections 12 substantially contact a ceiling surface 14 of the cavity 4 when the insulation displacement terminal fitting 5 is inserted into the cavity 4. Left and right crimping pieces 13 project behind the projections 12 and are crimped into connection with the outer coating WB of the wire W to fix the wire W.

Figure 2:
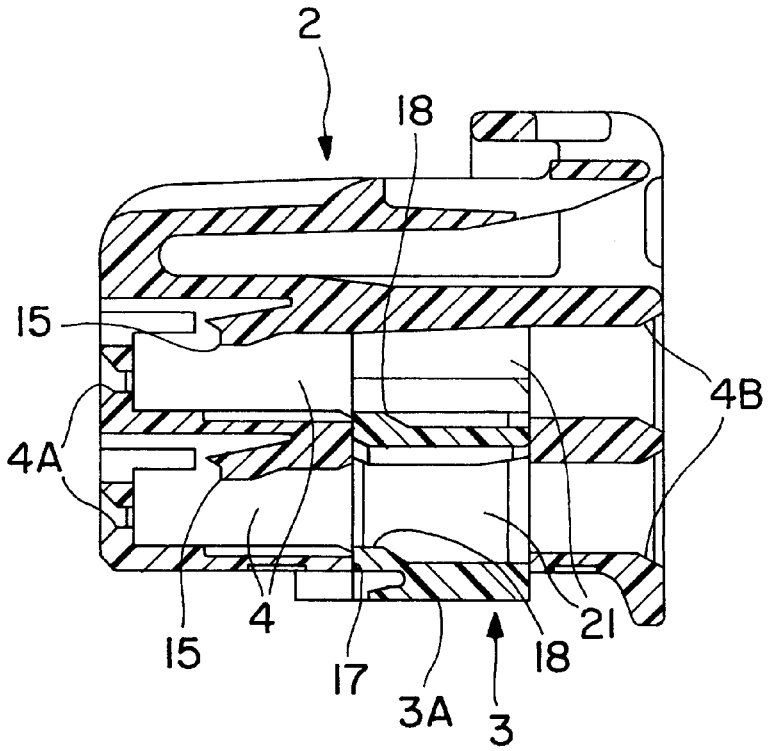
FIG. 2 is a side view in section of a housing.
Figure 3:
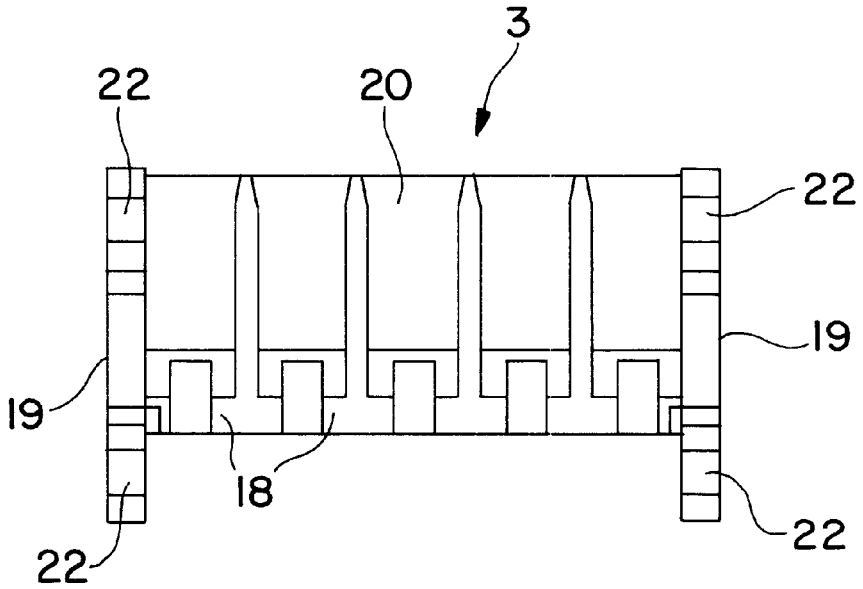
FIG. 3 is a plan view of a retainer.
Figure 4:
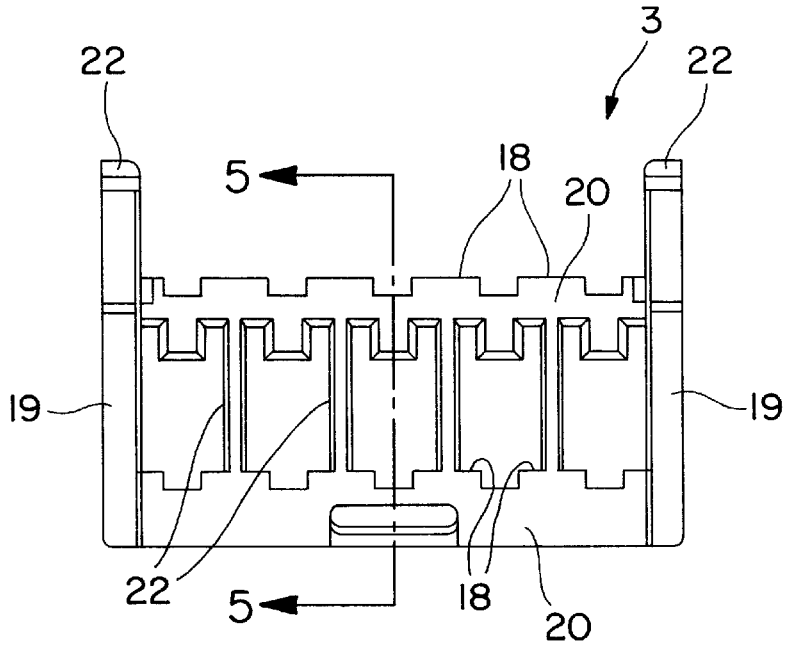
FIG. 4 is a front view of the retainer.
Figure 5:
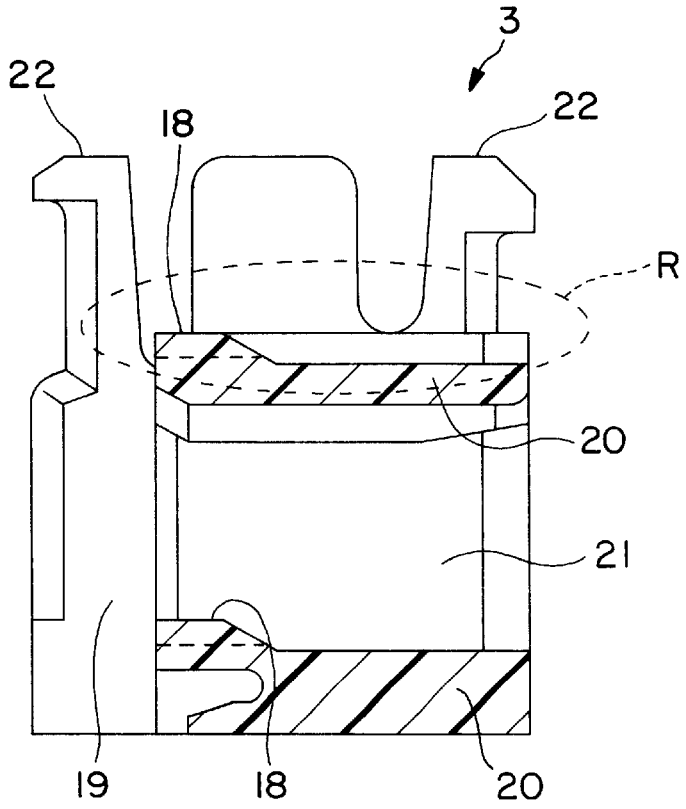
FIG. 5 is a section along 5—5 of FIG. 4.

The housing 2 preferably is formed integrally or unitarily from a synthetic resin to define a substantially rectangular parallelepiped shape, and cavities 4 extend in forward and backward directions at upper and lower stages inside the housing 2. Small tab insertion holes 4A are formed at the front of each cavity 4 to receive mating male tabs, whereas larger terminal mount openings 4B are formed at the rear of each cavity 4 to permit insertion of the terminal fittings 5, 6 into the cavities 4. A lock 15 projects from the front of the upper wall surface in each cavity 4 and is elastically deformable in a vertical direction. The locks 15 engage the engaging holes 16 in the connecting portions 8 of the terminal fittings 5, 6 for partly locking the terminal fittings 5, 6 in the cavities. Further, one side wall (bottom wall in FIG. 2) of the housing 2 is formed with a retainer mount opening 17 that communicates with the cavities 4. The retainer 3, described later, can be inserted through the retainer mount opening 17.

The retainer 3 is molded integrally or unitarily from a resin, and can be mounted into the retainer mount opening 17 of the housing 2 to redundantly lock the terminal fittings 5, 6 in the cavities 4. The retainer 3 is provided with terminal locks 18 for locking the terminal fittings 5, 6 in the cavities 4. The terminal locks 18 are provided at upper and lower stages and correspond to the cavities 4 of the housing 2. Specifically, the retainer 3 has left and right side plates 19 and upper and lower bridges 20 that extend between the side plates 19. The terminal locks 18 project from both bridges 20. Sectioning pieces 21 extend between the upper and lower bridges 20 and are spaced sufficiently to conform to the width of the cavities 4 of the housing 2. The sectioning pieces 21 enhance the strength of the retainer 3 and section the respective cavities 4 when the retainer 3 is assembled with the housing 2.

Front and rear elastically deformable engaging legs 22 project from each side plate 19, and the retainer 3 and the housing 2 can be locked into each other by engaging the legs 22 with engaging portions (not shown) in the housing 2. The engaging legs 22 can be engaged with the housing 2 in two locking positions having different depths. In a partial locking position, shown in FIGS. 2 and 7, the retainer 3 is inserted only partially, but is engaged with the housing 2. In this partial locking position, the leading ends of the terminal locks 18 are substantially flush with the ceiling surfaces 14 of the cavities 4 or are in positions retracted more toward the retainer mount opening 17 than the corresponding ceiling surfaces 14. Thus, the terminal fittings 5, 6 can be inserted into and withdrawn from the cavities 4. At this stage, a pushing surface 3A of the retainer 3 projects from the bottom surface of the housing 2.

Figure 10:
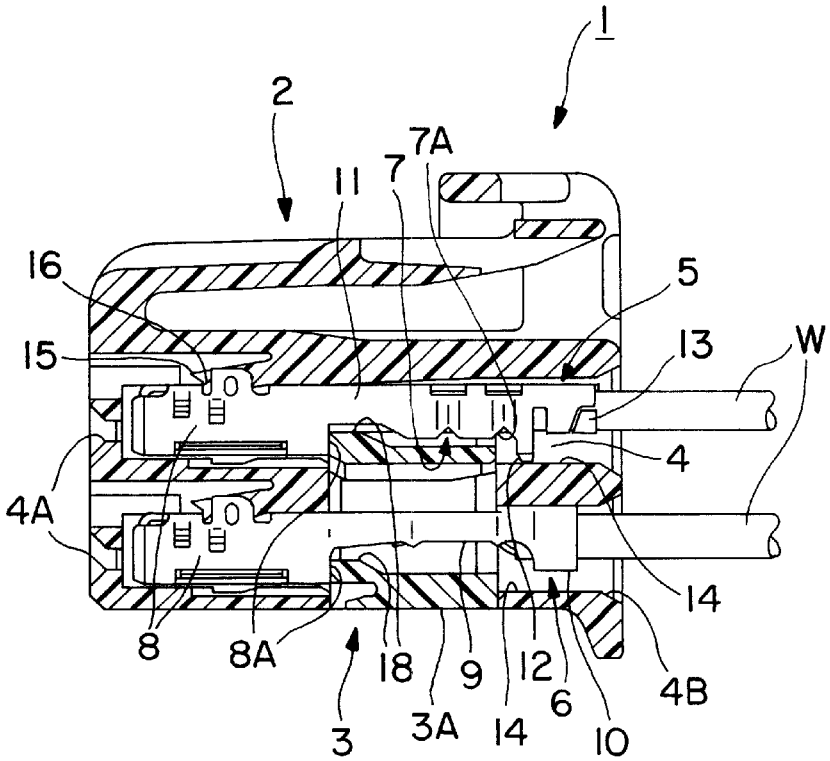
FIG. 10 is a cross-sectional view similar to FIG. 8, but with the retainer pushed to its full locking position.
Figure 11:
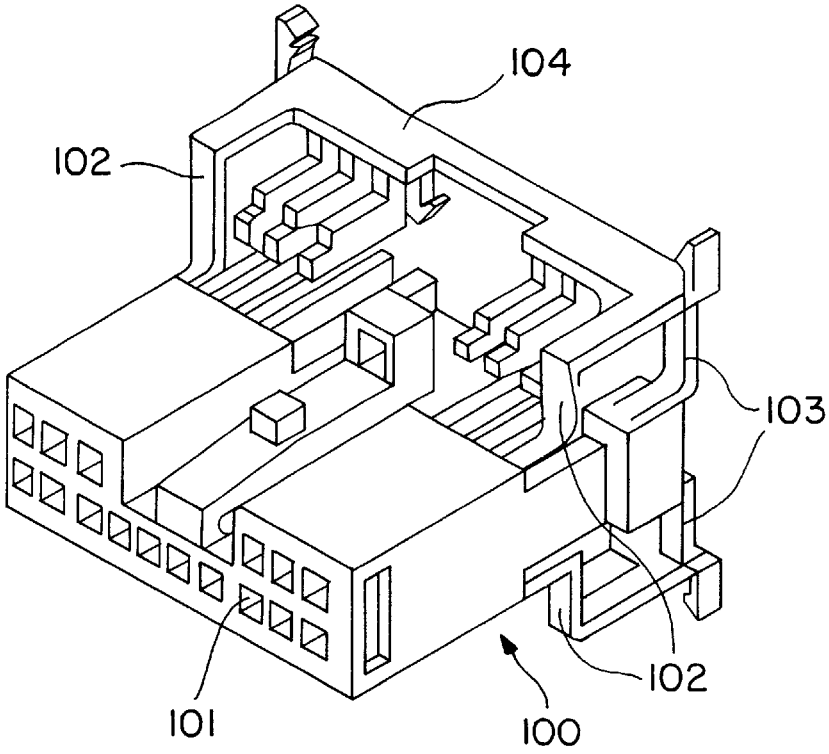
FIG. 11 PRIOR ART
FIG. 11 is a perspective view of a housing of a prior art connector.
Figure 12:
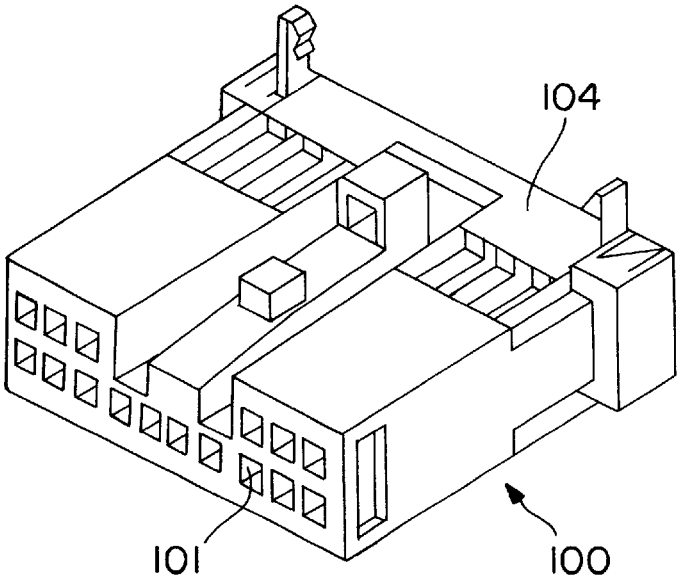
FIG. 12 PRIOR ART
FIG. 12 is a perspective view of the prior art connector when retainers are assembled with the housing.
Figure 13:
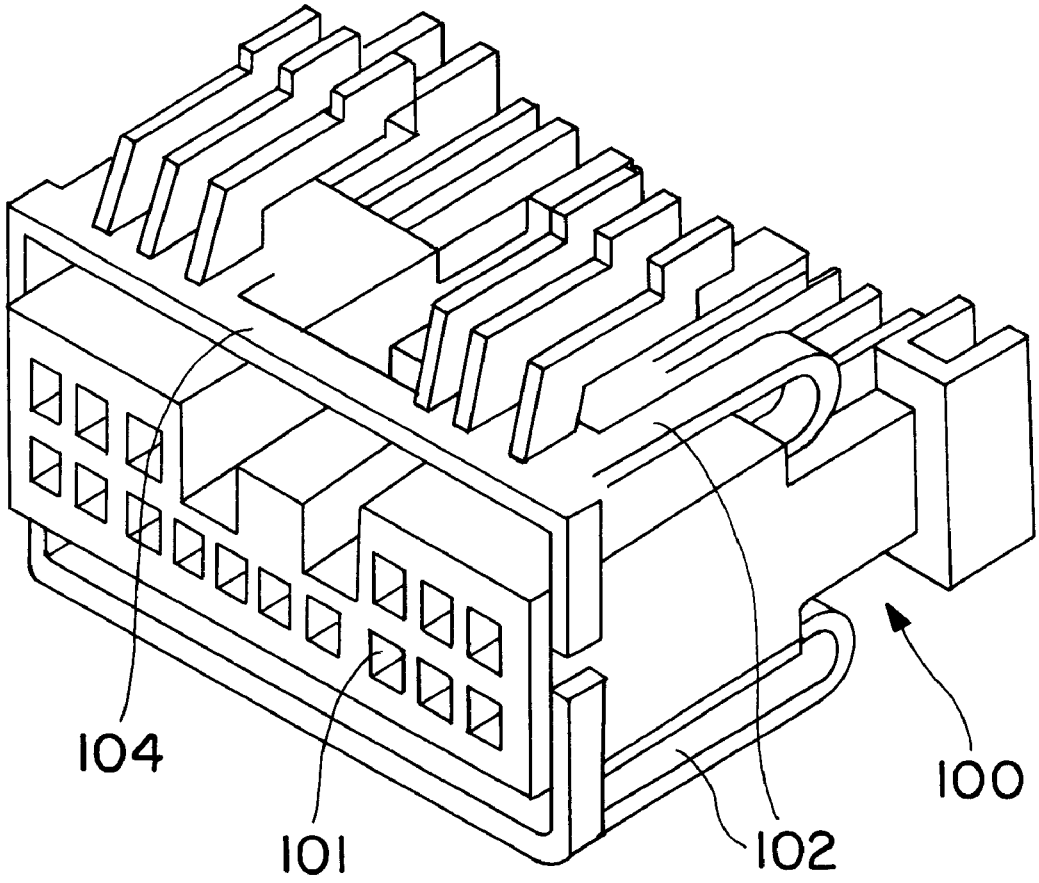
FIG. 13 PRIOR ART
FIG. 13 is a perspective view of the prior art connector when retainers are assembled with the housing.

The retainer 3 can be inserted to a full locking position, shown in FIG. 10. In the full lock position, the pushing surface 3A of the retainer 3 is substantially flush with the side surface of the housing 2 and the terminal locking portions 18 enter the cavities 4 to engage the steps 8A at the rear ends of the connecting portions 8. As a result, the terminal fittings 5, 6 are redundantly locked in the cavities 4.

Figure 7:
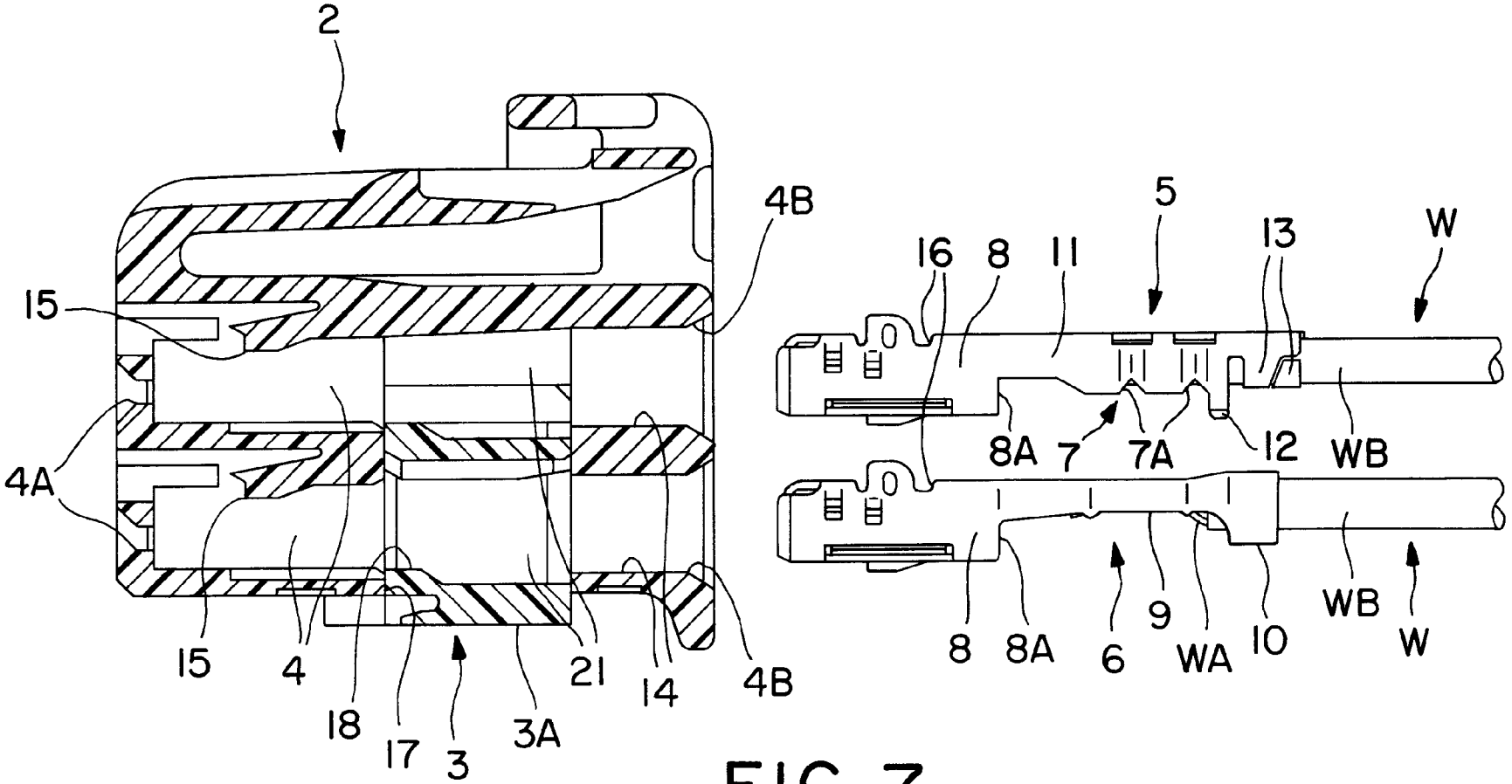
FIG. 7 is a longitudinal cross-sectional view showing a state before terminal fittings are accommodated in cavities and with the retainer in the partial locking position.
Figure 6:
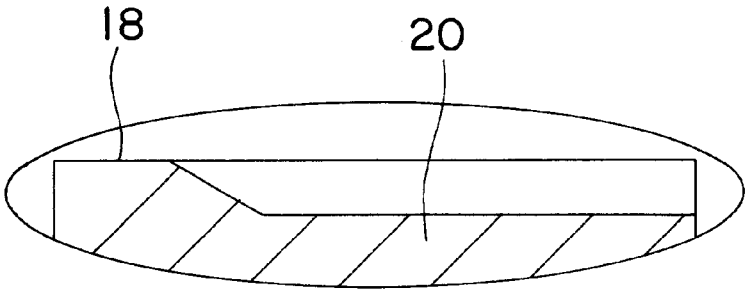
FIG. 6 is a partial enlarged view of an ellipse R of FIG. 5.

The connector is assembled by first connecting the ends of the wires W with the crimping and insulation-displacement terminal fittings 5, 6. The insulation-displacement terminal fittings 5 are connected with the wires W by pushing the wires W between the insulation-displacement portions 7, whereas the crimping terminal fittings 6 are connected with the wires W by crimping the barrels 9, 10 into connection with the wires W. The retainer 3 is engaged with the housing 2 in the partial locking position, as shown in FIG. 7. In this position, the terminal locks 18 do not project into the cavities 4. Thus, the terminal fittings 5, 6 can be inserted into and withdrawn from the cavities 4. FIG. 7 shows the insulation-displacement terminal fittings 5 at the upper stage and the crimping terminal fittings 6 at the lower stage. However, both terminal fittings 5 and 6 can be mounted in any of the cavities 4 in this embodiment.

Figure 8:
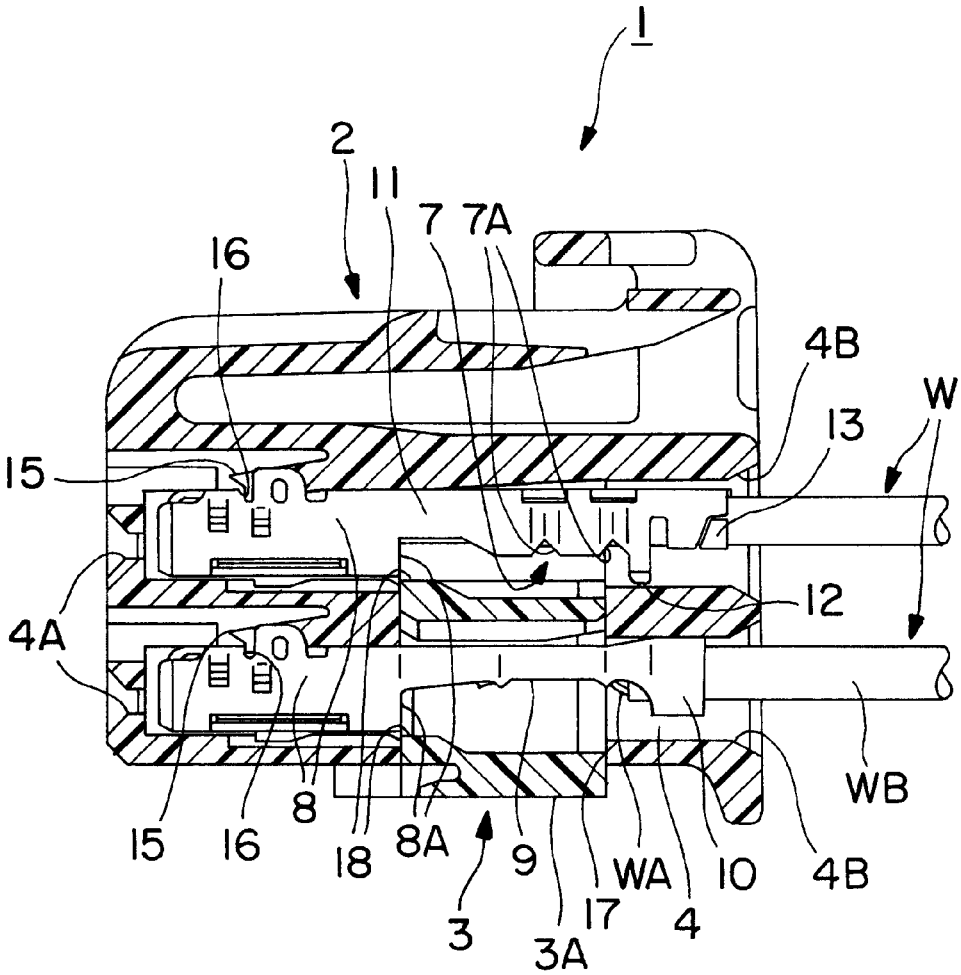
FIG. 8 is a cross-sectional view similar to FIG. 7 showing the terminal fittings in the cavities and the retainer in the partial locking position.
Figure 9:
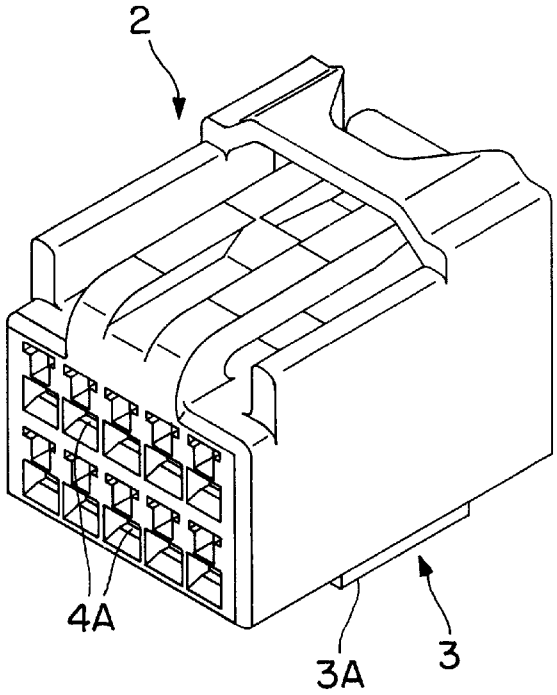
FIG. 9 is a perspective view of the connection when the retainer is in its partial locking position.

The terminal fittings 5, 6 are pushed into the cavities 4 from the rear. Pushing forces on the terminal fittings 5, 6 cause the connecting portions 8 to deform the locks 15 upward or toward the corresponding side of the housing 2. When the terminal fittings 5, 6 are pushed to specified proper insertion positions, the locks 15 reach the engaging holes 16 and restore substantially to their original shapes, thereby partly locking the terminal fittings 5, 6 as shown in FIG. 8.

Pushing forces on the pushing surface 3A move the retainer 3 to the full locking position, thereby completing assembling of the connector 1. At this stage, the terminal locks 18 enter the cavities 4 and engage the steps 8A at the rear ends of the connecting portions 8. As a result, the terminal fittings 5, 6 are redundantly locked in the cavities 4.

According to this embodiment, the height of the insulation-displacement portions 7 is less than the height of the connecting portion 8 in the insulation-displacement terminal fitting 5. Thus, terminal locks 18 can be formed on the retainer 3 to engage both the crimping terminal fittings 6 and the insulation-displacement terminal fittings 5. Accordingly, the retainer 3 can be mounted in the retainer mount opening 17 to lock both the crimping terminal fittings 6 and the insulation-displacement terminal fittings 5 in the cavities 4 of the housing 2.

The retainer 3 is of the side type and can push the terminal fittings 5, 6 to the same locking position with respect to the housing 2 regardless of the kind of the terminal fittings 5, 6. Thus, automation can be implemented easily.

The technical scope of the present invention is not limited to the aforementioned embodiment and also embraces, for example, an embodiment as below. Besides the technical scope of the present invention extends to the scope of equivalents.

Although the crimping and insulation-displacement terminal fittings 5, 6 are both female terminal fittings in the foregoing embodiment, they may be male terminal fittings according to the present invention.

Although two stages of cavities are shown in the described embodiment, it is to be understood that only one or three or more stages of cavities 4 may be provided in the housing 2 of the connector according to the invention.

What is claimed is:

1. A connector, comprising:

a housing with front and rear ends and a plurality of sidewalls extending between the front and rear ends, a plurality of substantially identical cavities extending through the housing from the front end to the rear end, a retainer mount opening extending into one of said sidewalls of the housing and communicating with the cavities;

at least one crimping terminal fitting with opposite front and rear ends, a connecting portion extending rearwardly from the front end for connection with a mating terminal fitting, a rearwardly facing step defined on the crimping terminal fitting a selected distance rearwardly from the front end, and at least one barrel configured for crimped connection with an exposed section of a core of a wire, the crimping terminal fitting being configured for insertion into any of the cavities;

at least one insulation-displacement terminal fitting with opposite front and rear ends, a connecting portion extending rearwardly from the front end of the insulation-displacement terminal fitting for connection with a mating terminal fitting, the connecting portion defining a selected height, a rearwardly facing step defined on the insulation-displacement terminal fitting at the selected distance rearwardly from the front end of the insulation-displacement terminal fitting, and insulation-displacement portions configured to cut an outer coating of a wire and connect with a core of the wire, the insulation-displacement portions defining a height less than the height of the connecting portion, the insulation-displacement terminal fitting being configured for insertion into any of the cavities; and a retainer to be mounted into the retainer mount opening, the retainer having terminal locks configured for engagement with the rearwardly facing step of both the crimping terminal fitting the insulation-displacement terminal fitting to lock the terminal fittings in the cavities.

2. A connector according to claim 1, wherein the connecting portion of the crimping terminal fitting and the connecting portion of the insulation-displacement terminal fitting are substantially identical in shape.

3. A connector according to claim 1, wherein the connecting portion of the crimping terminal fitting and the connecting portion of the insulation-displacement terminal fitting have engaging holes configured and disposed for engagement with corresponding mating locks in the housing when the terminal fittings are inserted in the cavities, wherein the mating locks can lock both the crimping terminal fitting and the insulation-displacement terminal fitting.

* * * * *